US010349747B2

(12) United States Patent
Capano-Rigal

(10) Patent No.: US 10,349,747 B2
(45) Date of Patent: Jul. 16, 2019

(54) OUTSIDE FURNITURE AND FURNITURE ASSEMBLY

(71) Applicant: Anna Capano-Rigal, Palavas les Flots (FR)

(72) Inventor: Anna Capano-Rigal, Palavas les Flots (FR)

( * ) Notice: Subject to any disclaimer, the term of this patent is extended or adjusted under 35 U.S.C. 154(b) by 0 days.

(21) Appl. No.: 15/548,111

(22) PCT Filed: Feb. 5, 2016

(86) PCT No.: PCT/FR2016/050256

§ 371 (c)(1),
(2) Date: Aug. 2, 2017

(87) PCT Pub. No.: WO2016/124871

PCT Pub. Date: Aug. 11, 2016

(65) Prior Publication Data

US 2018/0014648 A1 Jan. 18, 2018

(30) Foreign Application Priority Data

Feb. 5, 2015 (FR) ..... 15 50918

(51) Int. Cl.

| | |
|---|---|
| ***F25D 3/06*** | (2006.01) |
| ***G07C 9/00*** | (2006.01) |
| ***A47C 1/14*** | (2006.01) |
| ***A47C 7/74*** | (2006.01) |
| ***E05G 1/00*** | (2006.01) |
| ***E05G 1/02*** | (2006.01) |
| ***E04H 12/22*** | (2006.01) |
| ***E05F 15/76*** | (2015.01) |

(52) U.S. Cl.
CPC ..... *A47C 1/14* (2013.01); *A47C 7/746* (2013.01); *E04H 12/2238* (2013.01); *E05F 15/76* (2015.01); *E05G 1/005* (2013.01); *E05G 1/02* (2013.01); *F25D 3/06* (2013.01); *G07C 9/00182* (2013.01); *A45B 2200/1054* (2013.01); *F25D 2303/081* (2013.01); *G07C 2009/0019* (2013.01)

(58) Field of Classification Search
CPC . A47C 1/14; A47C 7/746; E05F 15/76; E04H 12/2238; E05G 1/005; E05G 11/02; F25D 3/06; G07C 9/00182
USPC ..... 4/619, 630
See application file for complete search history.

(56) References Cited

U.S. PATENT DOCUMENTS 4,437,714 A * 3/1984 Struck ..... A47B 69/00 108/25
7,284,393 B1 * 10/2007 Macmillan ..... F25D 3/06 62/331

(Continued)

*Primary Examiner* — Tuan N Nguyen
(74) *Attorney, Agent, or Firm* — Patshegen IP LLC; Moshe Pinchas

(57) ABSTRACT

The invention relates to a piece of outside furniture including a hollow space closed by a door; a lock for locking the door in position when the door is closed. The piece of outside furniture further includes a transmitter-receiver of an electromagnetic wave, the and the lock is configured to unlock the position of the door when a received electromagnetic wave, from a radio frequency identification tag having received an emitted electromagnetic wave, comprises predefined information. The piece of outside furniture further includes a through-opening, configured to allow the passage of a post planted in the ground.

13 Claims, 3 Drawing Sheets

(56) References Cited

U.S. PATENT DOCUMENTS

2014/0041558 A1* 2/2014 Lubotta ..... E05G 1/08
109/38
2014/0366784 A1* 12/2014 Berger ..... E05G 1/005
109/23

* cited by examiner

OUTSIDE FURNITURE AND FURNITURE ASSEMBLY

TECHNICAL FIELD OF THE INVENTION

The present invention relates to a piece of outdoor furniture and an assembly of such pieces of furniture. It applies, in particular, to beach furniture.

STATE OF THE ART

The risks of the theft of personal items on the beach result in a number of consequences:

- the fact that people deliberately choose not to bring some items, even if useful, for fear of theft;
- the permanent surveillance of his personal items, which means the person cannot relax; and
- the fact of hiding these personal items in the hope that nothing untoward occurs.

In some current systems, a mobile strongbox is brought to the beach. However, since this strongbox is mobile, it is likely to be stolen, although with more difficulty.

SUBJECT OF THE INVENTION

The present invention aims to remedy all or part of these drawbacks.

To this end, according to a first aspect, this invention envisages a piece of outdoor furniture, which comprises:

- a hollow space closed by a door;
- a means for locking the door in position when this door is closed; and
- a transmitter-receiver of an electromagnetic wave, the locking means being configured to unlock the position of the door when a received electromagnetic wave, from a radio frequency identification tag having received an emitted electromagnetic wave, comprises predefined information.

Thanks to these provisions, the locking means prevents unauthorized access to the contents of the hollow space. This anti-theft function means a user does not have to watch his personal effects on a public beach. In addition, the transmitter-receiver allows the door to be locked in position when a user equipped with a radio frequency identification tag is a sufficient distance away from the piece of furniture.

In some embodiments, the piece of furniture that is the subject of the invention comprises an opening configured to allow the passage of a parasol base.

These embodiments enable any attempted theft of the piece of outdoor furniture to be made visible because of the visibility of a parasol, especially in the deployed position.

In some embodiments, the locking means is a locking means with no physical key.

These embodiments make it possible to avoid loss of the physical key resulting in access to the contents of the hollow space being impossible.

In some embodiments, the piece of furniture that is the subject of the present invention comprises a housing for ice-cubes positioned above the hollow space, such that placing ice-cubes in this housing cools the contents of the hollow space.

These embodiments make it possible to keep food or drinks, for example, cool, while the contents of the hollow space are cooled so as to reduce any damage caused by the heat of this confined space.

In some embodiments, the piece of furniture that is the subject of the present invention comprises at least one aperture positioned above the housing for ice-cubes.

These embodiments make it possible to insert a bottle or a glass in the housing for ice-cubes accessible without having to open the housing for ice-cubes.

In some embodiments, the piece of furniture that is the subject of the present invention comprises at least two apertures, one aperture having greater opening dimensions than the dimensions of at least one other aperture.

These embodiments make it possible to insert both a bottle and a glass into the different apertures according to the dimensions of these apertures.

In some embodiments, the piece of furniture that is the subject of the present invention comprises a reservoir configured to receive water, and a shower supplied with water by the reservoir.

In some embodiments, the piece of furniture that is the subject of the present invention comprises a deployable mount fixed to a hinge, this hinge being fixed to an upper surface of the piece of furniture.

These embodiments make it possible to place objects on the upper surface of the piece of furniture.

In some embodiments, the piece of furniture that is the subject of the present invention comprises a compartment closed by a door, this door forming a portion of the upper surface of the piece of furniture when this door closes the compartment.

These embodiments make it possible to store objects in the compartment.

In some embodiments, the piece of furniture that is the subject of the present invention comprises an electrical power supply insert for an external device.

These embodiments enable an external device, for example a smartphone, to be supplied with electricity with a view to recharging the battery of this device.

In some embodiments, the piece of furniture that is the subject of the present invention comprises a photovoltaic sensor supplying the insert with electricity.

These embodiments make it possible to power the insert independently.

In some embodiments, the piece of furniture that is the subject of the present invention comprises a wireless signal transmitter comprising a switch actuating the transmission of a signal.

These embodiments make it possible, for example, to attract the attention of a third party receiving the wireless signal.

In some embodiments, the opening is formed by a side arch of the piece of furniture.

These embodiments enable the modular assembly of several pieces of furniture or modules making up a larger piece of furniture.

According to a second aspect, the present invention envisages an assembly, which comprises a plurality of furniture that is the subject of the present invention, openings of said pieces of furniture being superimposed so as to be passed through by a rectilinear post.

As the particular aims, advantages and features of the assembly that is the subject of the present invention are similar to those of the piece of outdoor furniture that is the subject of the present invention, they are not repeated here.

BRIEF DESCRIPTION OF THE FIGURES

Other advantages, aims and particular features of the invention will become apparent from the non-limiting description that follows of at least one particular embodiment of the piece of outdoor furniture and the assembly that are the subjects of the present invention, with reference to drawings included in an appendix, wherein.

DESCRIPTION OF EXAMPLES OF REALIZATION OF THE INVENTION

The present description is given as a non-limiting example, each characteristic of an embodiment being able to be combined with any other characteristic of any other embodiment in an advantageous way.

It is now noted that the figures are not to scale.

Figure 1:
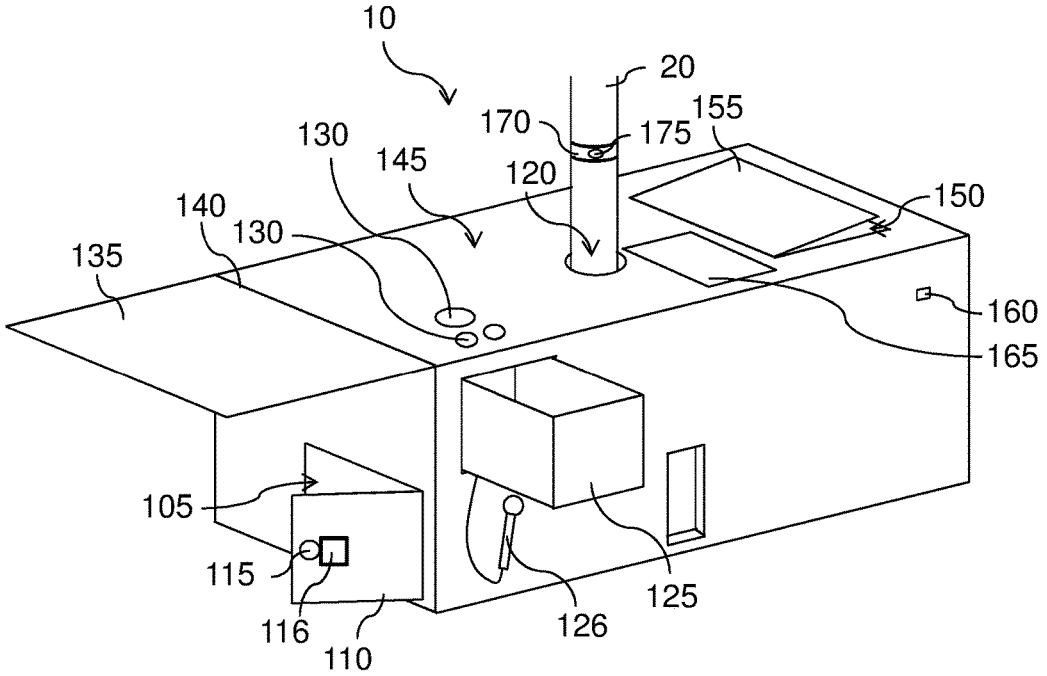
FIG. 1 represents, schematically and in perspective, a particular embodiment of the piece of outdoor furniture that is the subject of the present invention.

FIG. 1, which is not to scale, shows a perspective view of an embodiment of the piece of furniture 10 that is the subject of the present invention. This piece of outdoor furniture 10 comprises:

- a hollow space 105 closed by a door 110;
- a means 115 for locking the door 110 in position when this door 110 is closed; and
- an opening 120 traversing, this opening 120 being configured to allow the passage of a post 20 planted in the ground.

The piece of furniture 10 has, for example, a rectangular parallelepiped shape. This piece of outdoor furniture 10 is configured, amongst others, to be positioned on a beach or on uneven ground. This piece of furniture 10 is, for example, made of molded plastic, wood or metal. Preferably, this piece of furniture 10 is made of plastic for reasons of weight, cost and wear.

This piece of furniture 10 preferably has dimensions and a weight allowing it to be carried by a single person.

A plurality of pieces of furniture 10 can be easily stacked and placed side-by-side when each piece of furniture 10 has a parallelepiped shape.

In one example of the use of the piece of furniture 10, this piece of furniture 10 is stored in a shed on a beach during the night and placed on the sand during the day, transport between the shed and the position on the beach being done by at least one person.

In some embodiments, the piece of furniture 10 that is the subject of the present invention comprises a reservoir 125 configured to receive water, and a shower 126 supplied with water by the reservoir 125.

In certain variants, the reservoir 125 and the housing 125 are combined, the water in the reservoir consisting of water obtained from the melting of the ice-cubes. The hollow space 105 makes it possible to store a user's personal effects or objects. This hollow space 105 is, for example, a cavity molded in the piece of furniture 10, this cavity being closed by the door 110.

The door 110 is, for example, a surface mounted on a hinge (not shown) allowing the door 110 to open towards the outside of the piece of furniture 10. In some variants, the door 110 is a sliding door.

The locking means 115 is, for example, a lock of the door 110, the movement of which is controlled by a combination lock code. To access the contents of the hollow space 105, the combination corresponding to a predefined code must be entered. In this way, the locking means 115 constitutes an anti-theft device for the contents of the hollow space 105.

Figure 4:
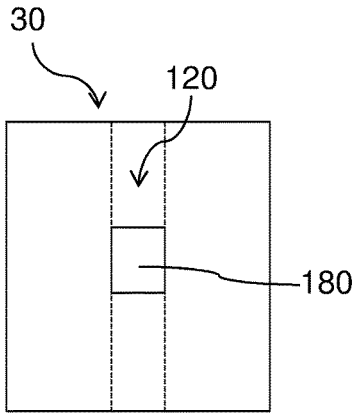
FIG. 4 represents, schematically and in a side view, the second particular embodiment of the piece of furniture that is the subject of the present invention.

In some preferred variants, as shown in FIG. 4, the piece of furniture 10 comprises a transmitter-receiver 116 of an electromagnetic wave, the locking means being configured to unlock the position of the door when a received electromagnetic wave, from a radio frequency identification tag having received an emitted electromagnetic wave, comprises predefined information.

The transmitter-receiver is, for example, an antenna using RFID (for "Radio Frequency Identification") or NFC (for "Near Field Communication") technology.

This transmitter-receiver makes it possible to detect information contained in a radio frequency identification tag, worn by a user as a pin, lapel badge, or bracelet.

The opening 120 is, for example, a cylindrical aperture surrounded by a wall formed by a material of the piece of furniture 10. In some variants, the opening is surrounded by only one portion of the periphery, these variants however presenting disadvantages of wear.

In some variants, the opening 120 is a ring or an arch.

Positioning a post 20 in the opening 120 makes it possible to keep the piece of furniture 10 in position, which forms a second anti-theft device preventing the theft of the hollow space.

In some embodiments, such as that shown in FIG. 1, the opening 120 is configured to allow the passage of a parasol base.

These embodiments are especially advantageous in the case of operations involving rest areas for hire on a shore, a parasol being associated with one or more chairs. In these cases, all or part of the parasols can be fixed to the inside of the opening 120 of a piece of furniture 10. The parasols have the advantage of being easily visible, their malicious removal in order to take the piece of furniture 10 being more visible as a result.

In some embodiments, such as that shown in FIG. 1, the locking means 115 is a locking means with no physical key. In some non-preferred variants, the locking means comprises a physical key allowing the door 110 to be unlocked.

In some embodiments, such as that shown in FIG. 1, the piece of furniture 10 comprises a housing 125 for ice-cubes positioned above the hollow space 105, such that placing ice-cubes in this housing 125 cools the contents of the hollow space 105.

This housing 125 is, for example, a drawer positioned under the upper surface 145 of the piece of furniture.

In some embodiments, such as that shown in FIG. 1, the piece of furniture 10 comprises at least one aperture 130 positioned above the housing 125 for ice-cubes. Each aperture 130 enables, for example, the positioning of a bottle or a glass, according to the dimensions of the aperture. This allows the glass or bottle to be cooled without opening the housing 125, which could cause the temperature inside the housing 125 to fall.

In some embodiments, such as that shown in FIG. 1, the piece of furniture 10 comprises at least two apertures 130, one aperture 130 having greater opening dimensions than the dimensions of at least one other aperture 130.

These embodiments enable, in particular, the placing of, firstly, glasses in the smaller apertures 130 and, secondly, a bottle in the larger apertures 130.

In some embodiments, such as that shown in FIG. 1, the piece of furniture 10 comprises a deployable mount 135 fixed to a hinge 140, this hinge 140 being fixed to an upper surface 145 of the piece of furniture 10. This mount makes it possible, in particular, to increase the surface area of the upper surface 145.

In some embodiments, such as that shown in FIG. 1, the piece of furniture 10 comprises a compartment 150 closed by a door 155, this door 155 forming a portion of the upper surface 145 of the piece of furniture 10 when this door 155 closes the compartment 150.

This compartment 150 is, for example, a cavity closed by a surface rotating around a hinge forming the door 155. This compartment 150 makes it possible to store objects of lesser value not requiring an anti-theft device to be utilized.

In some embodiments, such as that shown in FIG. 1, the piece of furniture 10 comprises an electrical power supply insert 160 for an external device.

This insert 160 is, for example, a USB bus ("Universal Serial Bus") making it possible to connect a USB cable charging, for example, a smartphone.

In some variants, any type of insert 160 is used that allows an electrical socket generally utilized to be connected.

In some embodiments, such as that shown in FIG. 1, the piece of furniture 10 comprises a photovoltaic sensor 165 supplying the insert 160 with electricity. This photovoltaic sensor 165 is attached, for example, on the upper surface 145 of the piece of furniture 10. The solar energy converted into electricity allows the insert 160 to be powered. In some variants, the solar energy makes it possible to power an electroacoustic transducer configured to play an audio signal transmitted by a communicating portable terminal, such as a smartphone for example. In some variants, the solar energy makes it possible to power a compressor of a shower supplied with water by the housing 125.

In some embodiments, such as that shown in FIG. 1, the piece of furniture 10 comprises a wireless signal transmitter 170 comprising a switch 175 actuating the transmission of a signal.

This transmitter 170 is, for example, an antenna configured to transmit a wireless signal over a radio channel to a receiver. The transmission of such a signal is actuated by pressing on a switch 175, such as a push-button for example.

In some variants, this transmitter 170 transmits a sound and/or light signal.

This transmitter 170 is positioned on the piece of furniture 10 or nearby, most often on the post 20.

The signal received by the receiver (not shown) makes it possible, in particular, to send a call to a user near the receiver.

In some embodiments, the piece of furniture 10 comprises a means for capturing the orientation of the piece of furniture 10, the transmitter 170 transmitting a signal when there is a predefined orientation, corresponding to the piece of furniture 10 being transported.

Figure 2:
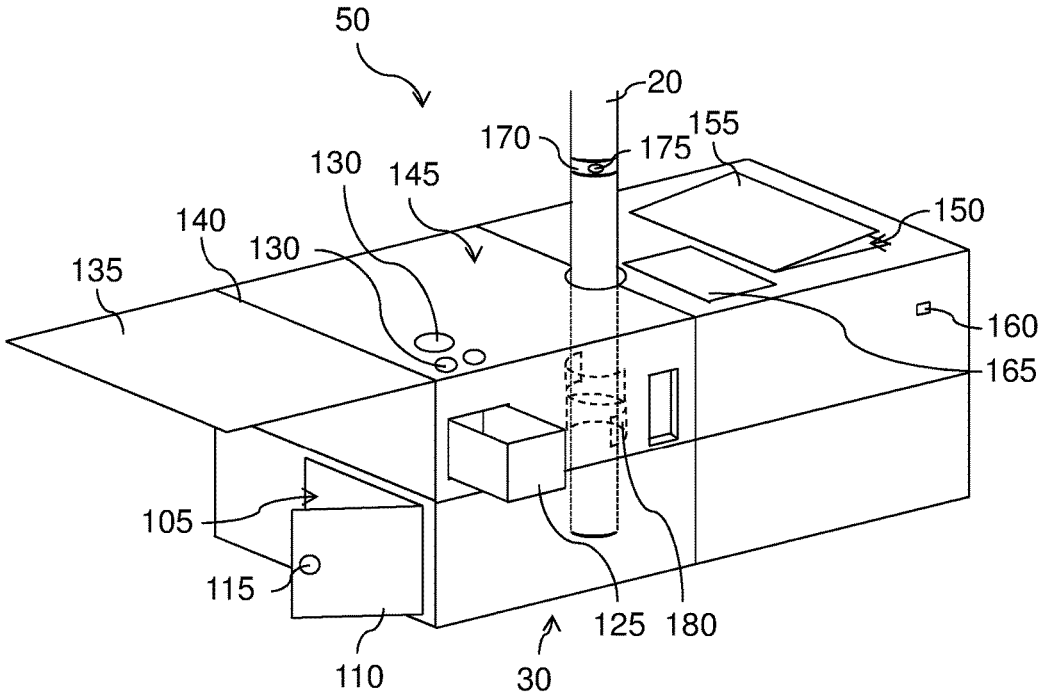
FIG. 2 represents, schematically and in perspective, a particular embodiment of the furniture assembly that is the subject of the present invention.

FIG. 2, which is not to scale, shows a perspective view of an embodiment of an assembly 50 that is the subject of the present invention. This assembly is made up of a set of pieces of furniture 30, similar to the piece of furniture 10 as described with regard to FIG. 1. In this embodiment, the pieces of furniture 30 comprise a side arch 180 forming an opening 180, each arch 180 being superimposed so as to be passed through by a rectilinear post 20.

In some embodiments, the height position of these arches 180 is adjustable.

Figure 3:
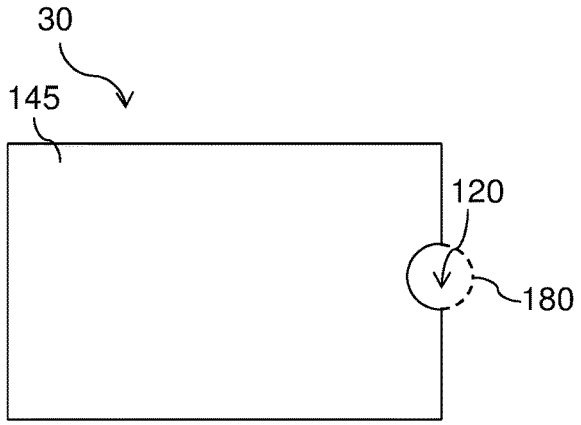
FIG. 3 represents, schematically and in a top view, a second particular embodiment of the piece of furniture that is the subject of the present invention.

FIG. 3 shows, schematically and in a top view, an embodiment of the piece of furniture 30 that is the subject of the present invention. It shows, in particular, the upper surface 145 of the piece of furniture 30, the opening 120 formed by, firstly, a semicircular depression and, secondly, an arch 180.

FIG. 4 shows, schematically and in a side view, an embodiment of the piece of furniture 30 that is the subject of the present invention. It shows, in particular, the opening 120 formed by, firstly, a semicircular depression and, secondly, an arch 180.

Figure 5:
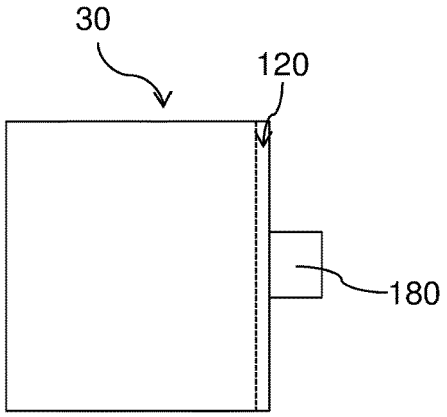
FIG. 5 represents, schematically and in a front view, the second particular embodiment of the piece of furniture that is the subject of the present invention.

FIG. 5 shows, schematically and in a front view, an embodiment of the piece of furniture 30 that is the subject of the present invention. It shows, in particular, the opening 120 formed by, firstly, a semicircular depression and, secondly, an arch 180.

It is noted that the arch 180 can be replaced by a hook or any other mechanical protuberance, deployable or not, to surround a post.

Figure 6:
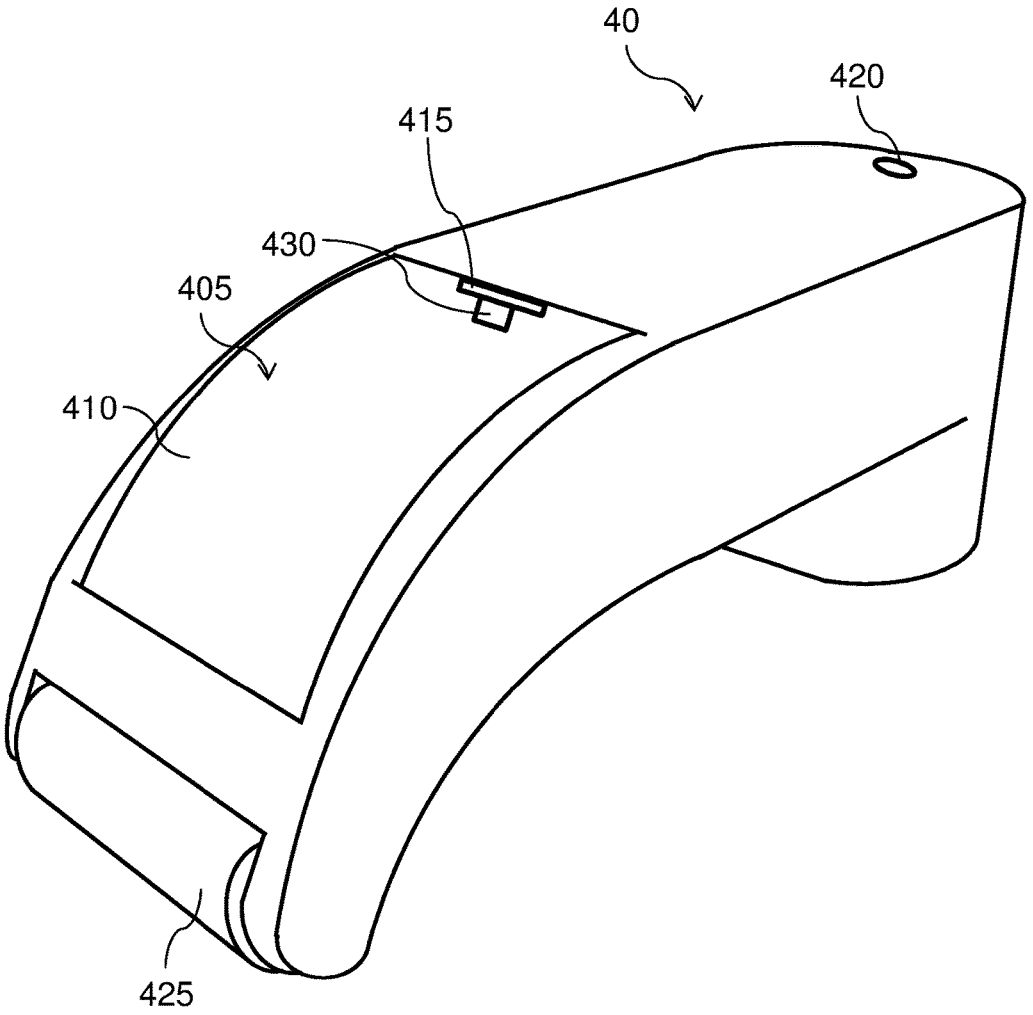
FIG. 6 represents, schematically and in perspective, a particular embodiment of the piece of outdoor furniture that is the subject of the present invention.

FIG. 6 shows, schematically and in a perspective view, a particular embodiment of the piece of furniture 40 that is the subject of the present invention. This piece of outdoor furniture 40 comprises:

- a hollow space 405 closed by a door 410;
- a means 415 for locking the door in position when this door is closed;
- a transmitter-receiver (430) of an electromagnetic wave, the locking means being configured to unlock the position of the door when a received electromagnetic wave, from a radio frequency identification tag having received an emitted electromagnetic wave, comprises predefined information; and
- a through-opening 420, this opening being configured to allow the passage of a post planted in the ground.

It shows, in particular, the presence of a roller 425 allowing the piece of furniture 40 to be moved.

It is now noted that all the characteristics described with reference to FIG. 1 can be utilized by the piece of the furniture 40 that is the subject of the present invention.

The hollow space 405 allows clothes and personal effects to be stored.

The through-opening 420 forms a guide for the post, the post being, for example, the post of a parasol. Preferably, the opening 420 is equipped with a tightening mechanism to adapt the opening 420 to any diameter of parasol post.

The locking means 415 is associated with a transmitter-receiver 430 of an electromagnetic wave, the locking means being configured to unlock the position of the door when the electromagnetic wave received comprises predefined information.

The transmitter-receiver 430 is, for example, an antenna using RFID (for "Radio Frequency Identification") or NFC (for "Near Field Communication") technology.

This transmitter-receiver 430 makes it possible to detect information contained in a radio frequency identification tag, worn by a user as a pin, lapel badge, or bracelet.

In some preferred variants, the piece of furniture 40 comprises a coolable housing allowing, for example, bottles of water or wine to be stored upright. This housing is preferably insulated, removable and able to be drained.

In some preferred variants, the piece of furniture 40 comprises a shower connected to a reservoir of water or to the coolable housing. In some variants, a pump is associated with the shower or the reservoir.

In some preferred variants, the piece of furniture 40 comprises at least one removable mounting bracket for a side tray. This mounting bracket is made, for example, of a mechanism for clipping the tray onto the piece of furniture 40.

In some preferred variants, the piece of furniture 40 comprises a removable means for fastening a bag or a bin designed to receive waste. This removable fastening means is, for example, a mechanism for clipping or clamping the bag or bin.

In some preferred variants, the piece of furniture 40 comprises side apertures in the form of shelves.

In some preferred variants, the piece of furniture 40 comprises a solar panel, this solar panel being, for example, attached on the outer surface of the door 410.

In some preferred variants, the piece of furniture 40 comprises a switch configured to trigger the transmission of a signal, wireless, light or via an antenna. Preferably, in the case of an antenna, this antenna is configured to transmit signals using the IEEE 802.11 standard, known as "Wi-Fi", to a control unit. This signal preferably comprises an item of information representative of an identifier of a piece of furniture 40 or the location of said piece of furniture.

In some preferred variants, the piece of furniture 40 comprises a USB insert allowing electronic peripherals to be charged.

In some preferred variants, the piece of furniture 40 comprises a bowl positioned on an upper surface of the piece of furniture 40.

In some preferred variants, the piece of furniture 40 comprises a stand-alone electrical power supply, such as a cell or a battery, for example.

The invention claimed is:

1. A piece of outdoor furniture, comprising:

a hollow space closed by a door;

a lock for selectively locking and unlocking the door in position when the door is closed;

a transmitter-receiver configured to detect information contained in a radio frequency identification tag, wherein said lock is configured to unlock the door when the transmitter-receiver detects said information and to lock the door when the radio frequency identification tag is at a distance from the transmitter-receiver such that said information is not detected;

a housing for ice-cubes positioned above the hollow space, such that placing ice-cubes in the housing cools the content of the hollow space.

2. The piece of outdoor furniture according to claim 1, which comprises an opening configured to allow the passage of a parasol base.

3. An assembly, comprising a plurality of pieces of outdoor furniture according to claim 2, wherein the opening of each of said pieces of outdoor furniture is superimposed such that a single rectilinear post can be disposed in the openings.

4. The piece of outdoor furniture according to claim 1, wherein the lock is a lock with no physical key.

5. The piece of outdoor furniture according to claim 1, which comprises at least one aperture positioned above the housing for ice-cubes.

6. The piece of outdoor furniture according to claim 5, which comprises at least two apertures, one aperture having greater opening dimensions than the dimensions of at least one other aperture.

7. The piece of outdoor furniture according to claim 1, which comprises a reservoir configured to receive water, and a shower supplied with water by the reservoir.

8. The piece of outdoor furniture according to claim 1, which comprises a deployable mount fixed to a hinge, the hinge being fixed to an upper surface of the piece of outdoor furniture.

9. The piece of outdoor furniture according to claim 1, which comprises a compartment closed by a door, the door forming a portion of the upper surface of the piece of outdoor furniture when the door closes the compartment.

10. The piece of outdoor furniture according to claim 1, further comprising an electrical power supply insert for an external device.

11. The piece of outdoor furniture according to claim 10, which comprises a photovoltaic sensor supplying the insert with electricity.

12. The piece of outdoor furniture according to claim 1, which comprises a wireless signal transmitter comprising a switch actuating the transmission of a signal.

13. The piece of outdoor furniture according to claim 1, wherein an opening is formed by a side arch of the piece of outdoor furniture.

* * * * *